US006574344B1

(12) United States Patent
Wiener et al.

(10) Patent No.: US 6,574,344 B1
(45) **Date of Patent: *Jun. 3, 2003**

(54) DIRECTIONAL HORN SPEAKER SYSTEM

(75) Inventors: David Wiener, Park City, UT (US); Steven Burgess, Salt Lake City, UT (US)

(73) Assignee: Soundtube Entertainment, Inc., Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/548,030

(22) Filed: Apr. 12, 2000

Related U.S. Application Data

(63) Continuation-in-part of application No. 09/030,976, filed on Feb. 25, 1998, now Pat. No. 6,055,320.

(51) Int. Cl.[7] ..... H04R 25/00

(52) U.S. Cl. ..... 381/343; 381/337; 381/340; 381/347; 381/352; 381/338; 381/342; 181/152; 181/159; 181/177; 181/179; 181/185; 181/198

(58) Field of Search ..... 381/343, 347, 381/337–340, 342, 346, 350–354, 87, 306, 387, 386, 333–335, 339, 341, 345, 349, 353; 181/152, 153, 159–161, 175, 179, 177, 180, 182, 187, 189, 192, 198, 199

(56) References Cited

U.S. PATENT DOCUMENTS

| | | | | |
|---|---|---|---|---|
| 1,866,921 A | | 7/1932 | Black | |
| 2,228,024 A | | 1/1941 | Abrahams | 181/26 |
| 3,486,578 A | | 12/1969 | Albarino | 181/31 |
| 3,750,838 A | | 8/1973 | Pyle, Jr. | 181/31 |
| 3,776,361 A | | 12/1973 | Rolle | 181/0.5 A |
| 3,816,672 A | | 6/1974 | Gefvert et al. | 179/115.5 |
| 3,832,888 A | | 9/1974 | Langlois | 73/67.5 H |
| 3,884,326 A | | 5/1975 | Orisek | 181/155 |
| 3,895,188 A | | 7/1975 | Ingraham | 179/1 MF |
| 3,908,095 A | | 9/1975 | Jinsenji | 179/102 |
| 3,945,461 A | | 3/1976 | Robinson | 181/153 |
| 3,978,941 A | | 9/1976 | Siebert | 181/151 |
| 3,982,607 A | | 9/1976 | Evans | 181/159 |
| 4,157,741 A | * | 6/1979 | Goldwater | |
| 4,164,988 A | | 8/1979 | Virva | 181/156 |
| 4,421,200 A | | 12/1983 | Ferralli et al. | 181/144 |
| 4,629,030 A | | 12/1986 | Ferralli | 181/155 |
| 4,635,749 A | * | 1/1987 | Tattersall | |
| 4,819,761 A | | 4/1989 | Dick | 181/145 |
| D311,539 S | | 10/1990 | Franzini et al. | D14/221 |
| 5,033,456 A | | 7/1991 | Pell et al. | 128/24 EL |

(List continued on next page.)

FOREIGN PATENT DOCUMENTS

| | | | |
|---|---|---|---|
| DE | 3214226 A1 | 10/1983 | |
| DE | 3902062 A1 | 1/1989 | H04R/1/34 |
| EP | 0 500 294 A2 | 8/1992 | H04R/5/02 |
| GB | 2 226 214 A | 6/1990 | |
| JP | 4247171 | 3/1992 | H04R/1/34 |

*Primary Examiner*—Rexford Barnie
*Assistant Examiner*—Dionne Harvey
(74) *Attorney, Agent, or Firm*—Gordon & Jacobson, P.C.

(57) ABSTRACT

A directional speaker system includes an enclosure having an inner surface, an outer surface, an open end, and a closed end, a speaker driver directed toward the open end and mounted near the closed end of the enclosure, an in-line phase plug mounted in front of the speaker driver for manipulating the wavefront of sound waves produced by the speaker driver, and a preferably frustoconical shaped wave guide provided between the speaker driver and the open end of the speaker enclosure. A preferably annular space is provided between the enclosure and the wave guide and a plurality of openings are provided between the enclosure at the open end of the enclosure. Out-of-phase sound waves produced by the speaker driver travel into the space and exit the speaker system through the openings.

13 Claims, 7 Drawing Sheets

U.S. PATENT DOCUMENTS

| | | | | | |
|---|---|---|---|---|---|
| 5,050,436 | A | | 9/1991 | Kunii et al. | 73/644 |
| 5,109,423 | A | | 4/1992 | Jacobson et al. | 381/156 |
| 5,173,575 | A | | 12/1992 | Furukawa | 181/160 |
| 5,199,075 | A | | 3/1993 | Fosgate | 381/24 |
| 5,220,608 | A | | 6/1993 | Pfister | 381/17 |
| 5,268,539 | A | | 12/1993 | Ono | 181/155 |
| 5,525,767 | A | | 6/1996 | Fields | 181/155 |
| 5,532,438 | A | | 7/1996 | Brown | 181/155 |
| 5,822,443 | A | * | 10/1998 | Kim | |
| 5,832,099 | A | * | 11/1998 | Wiener | |
| 5,933,508 | A | | 8/1999 | Fuke et al. | 381/343 |
| 5,956,411 | A | * | 9/1999 | Edgar | |
| 6,055,320 | A | * | 4/2000 | Wiener | |
| 6,363,157 | B1 | * | 3/2002 | Chick | |

* cited by examiner

DIRECTIONAL HORN SPEAKER SYSTEM

This application is a continuation-in-part of U.S. Ser. No. 09/030,976, filed Feb. 25, 1998 now U.S. Pat. No. 6,055, 320, which is hereby incorporated by reference herein in its entirety.

BACKGROUND OF THE INVENTION

1. Field of the Invention

This invention relates broadly to audio speaker systems. More particularly, this invention relates to a horn-type audio speaker system which limits the dispersion of sound output from the speaker system.

2. State of the Art

A number of speaker systems are known for focusing sound. Sound focusing speaker systems have particular application where it is desired to prevent sound emitted by one speaker system from interfering with sound emitted by another speaker system. These speaker systems are also useful for "listening stations" where it is desired that only listeners at the listening station be able to hear the sound from the speaker system.

Typically, a sound focusing speaker system uses a concave lens and a speaker directed into the concave lens. Ideally, the lens reflects sound from the speaker such that the sound reflected is confined to a desired area. For example, U.S. Pat. No. 5,268,539 to Ono discloses a partial ellipsoid sound lens having a speaker at one focus of the lens. Proper placement of the speaker at one focus results in the sound being reflected by the lens and focusing at the second focus of the ellipse, where the listener is ideally positioned. Unless a listener has his or her ears located at the second focus, listening will not be optimal. In addition, because sound is reflected back toward the second focus from many angles, sound will overshoot the second focus, and failing to be contained, will strike floor surfaces and disperse. The dispersion of sound will provide auditory interference to others in the vicinity of the ellipsoid sound lens.

U.S. Pat. No. 5,532,438 to Brown discloses a sound lens speaker system similar to the Ono system. The Brown system includes a spherical dome and left and right channel speakers (each speaker reproducing the same frequency range) directed into the dome. The speakers are oriented such that sound from the speaker reflects off the inside of the dome and is purportedly focused in stereo at the listeners ears. The Brown system suffers from the same drawbacks as the Ono system. The ears of the listener must be particularly positioned at a particular height relative to the dome to accurately hear the reflected sound. In addition, the speakers will cause sound to spill over outside the spherical dome. Furthermore, the spherical shape of the dome will likely further propagate uncontrolled sound scatter outside the dome.

Museum Tools of San Rafael, Calif., offers a sound lens speaker system under the name Secret Sound® which includes a parabolic sound lens and a speaker located at the focus of the parabolic lens. The speaker radiates sound upward into the sound lens and the sound lens then focuses the sound into a substantially vertical beam of sound, thereby reducing the amount of sound which is uncontrollably scattered. However, contrary to the Secret Sound® literature, the Secret Sound® sound lens is not designed to handle a full spectrum of humanly audible sound. The curvature and size of the parabolic lens is not optimized to accurately reflect both high and low frequency sound waves.

An additional complicating factor, which has not adequately been taken into consideration in the prior art, is that sound produced from each of the speakers into its respective lens has a spherical wavefront, which naturally disperses in an uncontrollable manner. None of the sound lens speaker systems of the prior art controllably confines the spherical wavefront of the sound it produces. Moreover, in each of the speaker systems of the prior art, the speakers are incapable of reproducing a broad spectrum of sound frequencies. Also, in all of the above speaker systems sound is radiated by the sound lens because the sound lens is formed from a single layer of material and the exterior surface of the sound lens is not acoustically isolated from the interior surface of the sound lens. As a result, sound waves produced by a speaker causes the sound lens to which it is coupled to radiate spurious sound.

SUMMARY OF THE INVENTION

It is therefore an object of the invention to provide a speaker system which is suitable for providing sound confined to a relatively small listening zone.

It is another object of the invention to provide a directional speaker system which limits the area of dispersion of sound output from the speaker system.

It is a further object of the invention to provide a directional speaker system which reproduces a broad frequency spectrum of sound.

It is an additional object of the invention to provide a directional speaker system having a horn-type configuration designed to optimally, controllably direct a broad spectrum of sound frequencies such that sound produced by the speaker system is confined to a relatively small area.

It is also an object of the invention to provided a speaker system which substantially converts the sound wavefront from spherical wavefront to a linear wavefront for improved directionality.

In accord with these objects which will be discussed in detail below, a directional speaker system which manipulates and confines sound waves includes a suspendable elongate enclosure having an inner surface, an outer surface, an open end, and a closed end, a speaker driver directed toward the open end and mounted near the closed end of the enclosure, an in-line phase plug mounted in front of the speaker driver, and a substantially frustoconically shaped wave guide (horn) provided between the speaker driver and the open end of the speaker enclosure. The inline phase plug is preferably cylindrically shaped and has a plurality of channels. The wave guide has an inner surface, an outer surface, a first open end provided near the speaker driver, a second open end located near the open end of the speaker enclosure, and a length preferably at least twice a dimension of the second open end. In addition, the open end of the enclosure is preferably provided with an acoustic trap; i.e., an acoustically absorbent ring of material provided around the inner perimeter of the open end. The absorbent ring preferably has a constricted opening relative to the second opening of the wave guide.

According to preferred aspects of the invention, an acoustically absorbent material is provided between the speaker enclosure and the wave guide. In addition, the speaker driver is preferably spaced apart from the mount to acoustically isolate the speaker driver from the mount and reduce acoustic vibration between the speaker driver and wave guide and the outer enclosure. According to the several embodiments of the invention, the enclosure can be generally cylindrical, rectilinear, or conical with a regular or irregular, e.g., undulating, surface. In addition, the wave guide can be have an arcuate side wall, e.g., the wave guide can be concave or convex.

According to one preferred embodiment of the invention, the speaker enclosure and the wave-guide are integrally molded or otherwise formed such that a hollow is provided between the inner surface of the enclosure and the outer surface of the wave guide. The hollow is then at least partially filled with the acoustically absorbent material. At the open end of the speaker enclosure, the enclosure is provided with a plurality of preferably evenly spaced apart openings. Sound waves propagated by the speaker driver in the forward direction exit the wave guide, while sound waves propagated rearward are out-of-phase with the forwardly directed sound waves and travel through the hollow to exit the openings. At the perimeter of the wave guide, the forward and rearward propagated sound waves are theoretically canceled by each other to confine the remaining sound waves and control dispersion. The preferred speaker system further comprises a wave guide phase plug having at least one cylindrical disc situated concentrically within the wave guide, a highly directional horn tweeter located beneath the wave guide phase plug and directed through the open end of the speaker enclosure, and a baffle plate provided above the acoustic trap. The wave guide phase plug and baffle plate operate to further flatten the wavefront, while the horn tweeter replaces some high frequencies lost due to wavefront manipulation.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
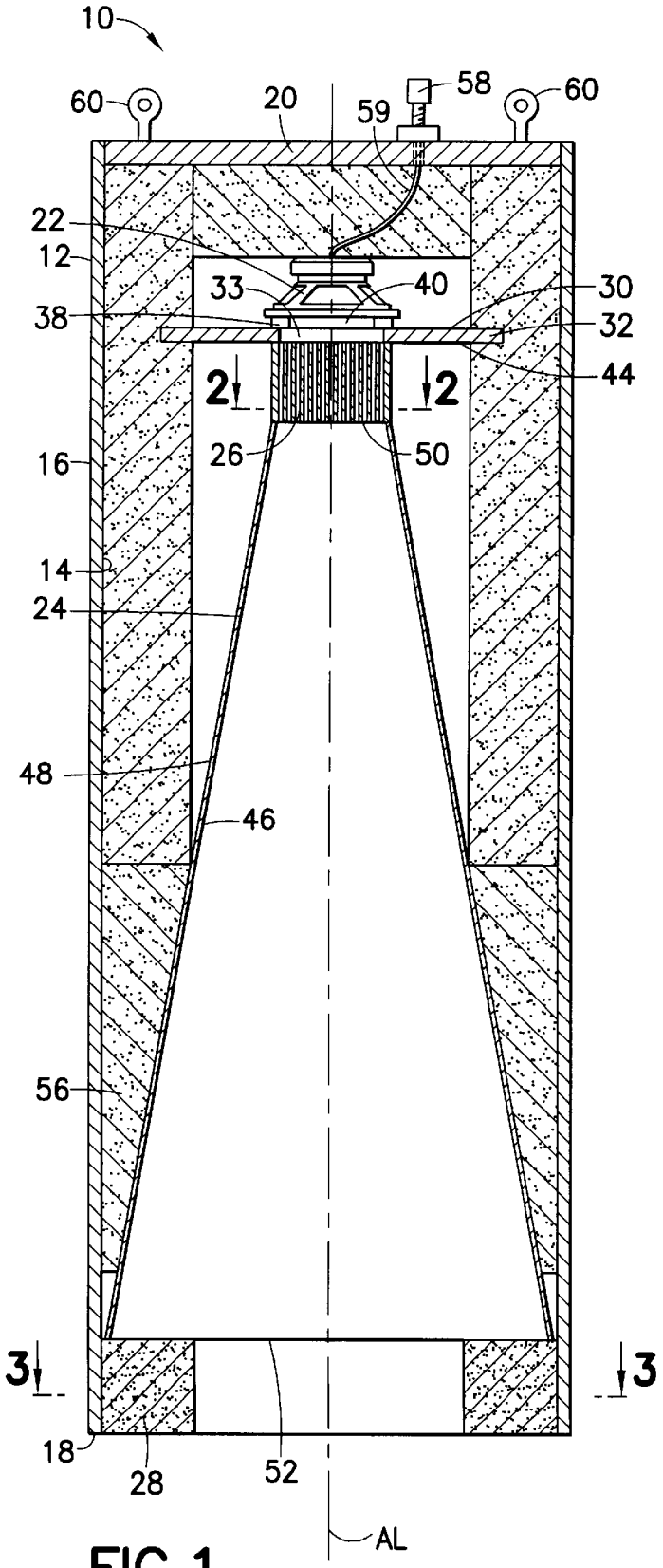
FIG. 1 is a partial side view of a first embodiment of a directional speaker system according to the invention.

Referring to FIG. 1, the speaker system 10 of the invention generally includes a rigid elongate enclosure 12 having an inner surface 14, an outer surface 16, an open end 18, and a closed end 20, a full-range speaker driver 22 within the enclosure 12 and directed toward the open end 18, and a wave guide (horn) 24 within the enclosure 12 for directionally projecting sound from the speaker driver 22 toward the open end 18. In addition, an in-line phase plug 26 is preferably positioned between the speaker driver 22 and the wave guide 24, and an acoustic trap 28 is preferably located at the open end 18 of the enclosure 12.

Figure 2:
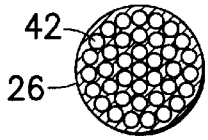
FIG. 2 is a cross-section through line 2—2 of FIG. 1.

More particularly, the speaker driver 22 is preferably a high fidelity speaker driver providing a relatively flat response (e.g., ±3 dB) throughout a large frequency range. The speaker driver 22 is mounted on the rear side 30 of a floating mount 32 via stand-off hardware 38 which provides a space 40, preferably approximately one quarter inch, between the speaker driver 22 and the mount 32. The mount 32 is preferably freely supported on a layer of acoustically absorbent material 56, which as described in more detail below, also surrounds the speaker driver 22 and wave guide 24. The mount 32 has a hole 33 concentric with the speaker driver 22 which permits sound to travel from the speaker driver 22 through the in-line phase plug 26 and wave guide 24. Referring to FIG. 2, the in-line phase plug 26 preferably has substantially the same cross-sectional area as the speaker driver. In addition, the in-line phase plug 26 is preferably cylindrically shaped and is provided with a plurality of channels 42 through which sound waves must pass to enter into the wave guide 24. Turning back to FIG. 1, the in-line phase plug 26 is preferably coupled to the front 44 of the mount 32, also concentric with the hole.

Figure 3:
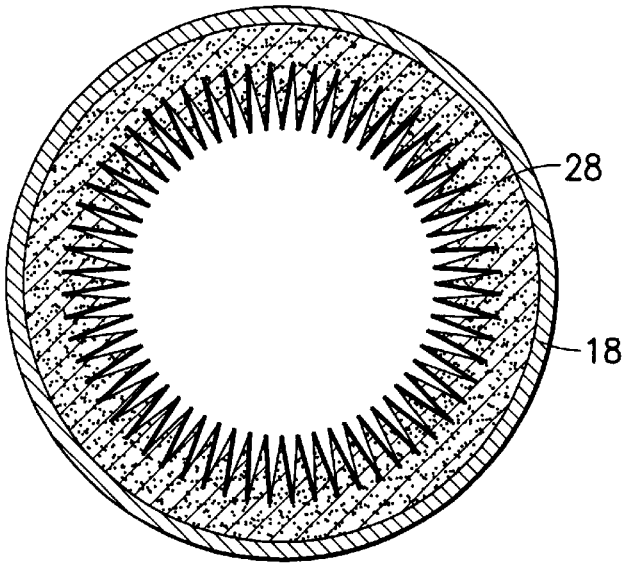
FIG. 3 is a cross-section through line 3—3 of FIG. 1.

The wave guide 24 of the speaker system 10 is preferably substantially frustoconically shaped, and has an inner surface 46, an outer surface 48, a constricted first open end 50 provided adjacent the in-line phase plug 26, and a second open end 52 preferably abutting the acoustic trap 28. The wave guide 24 preferably has a length at least twice a dimension, e.g, diameter, of the second open end 52. The acoustic trap 28 is comprised of an acoustically absorbent material, e.g., a sponge-like foam, provided around the inner perimeter of the open end 18 of the enclosure 12. The acoustic trap 28 has a constricted opening relative to the second opening of the wave guide. As shown in FIG. 3, the acoustically absorbent material preferably has a saw-tooth configuration.

Figure 4:
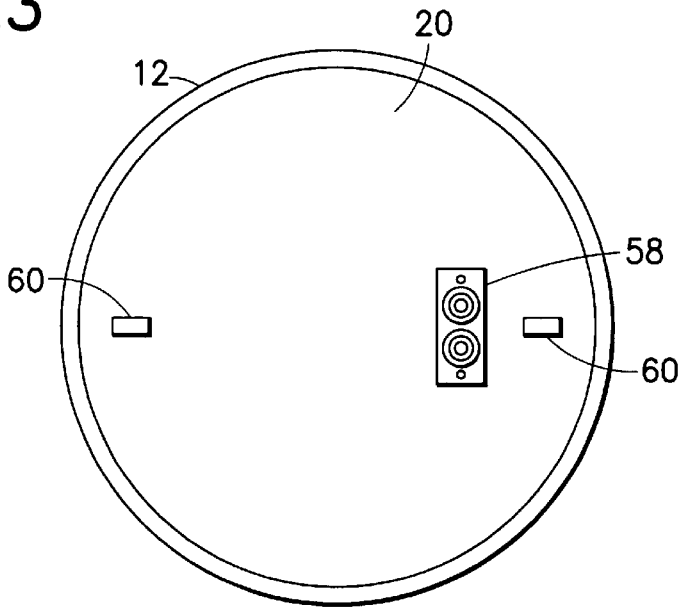
FIG. 4 is a top view of FIG. 1.
Figure 5:
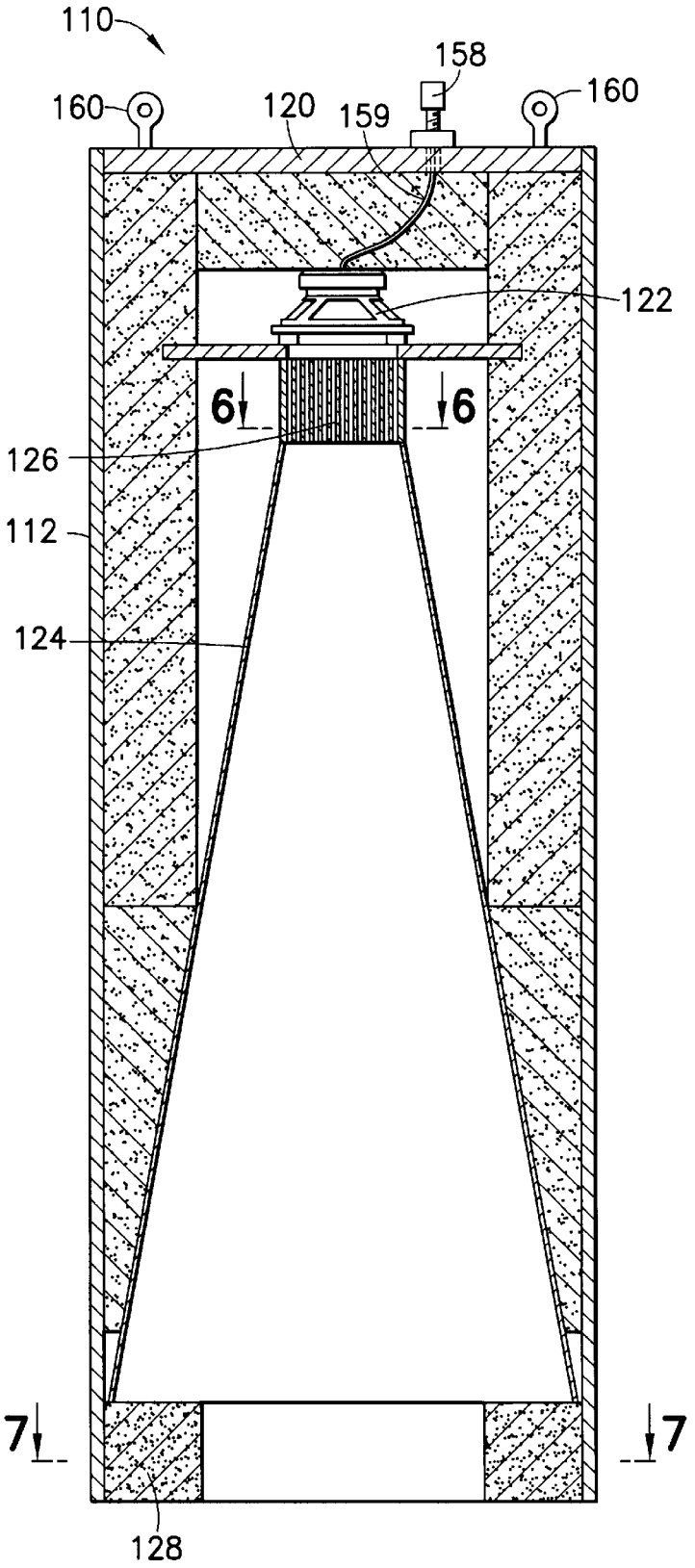
FIG. 5 is a partial side view of a second embodiment of a directional speaker-system according to the invention.
Figure 6:
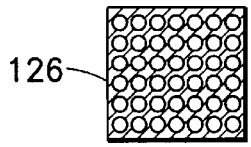
FIG. 6 is a cross-section through line 6—6 of FIG. 5.
Figure 7:
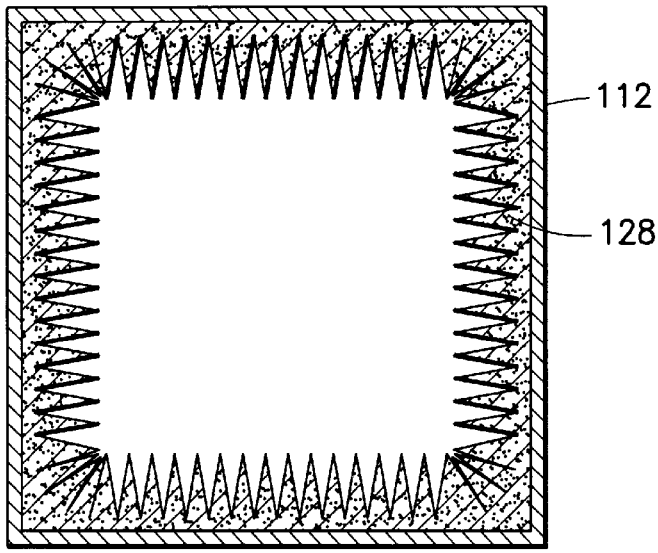
FIG. 7 is a cross-section through line 7—7 of FIG. 5.
Figure 8:
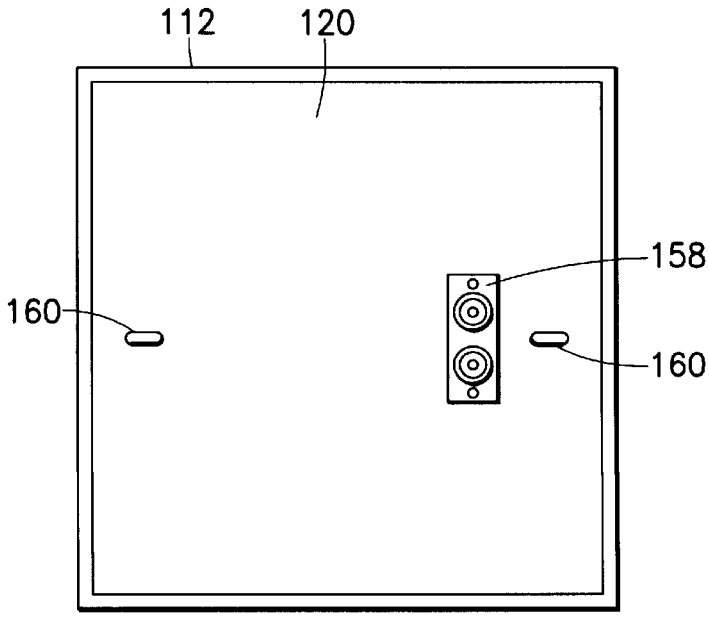
FIG. 8 is a top view of FIG. 5.

Turning back to FIG. 1, acoustically absorbent material 56 is preferably provided between the outer surface 48 of the wave guide 24 and the inner surface 14 of the enclosure 12, and also between the speaker driver 22 and the closed end 20 of the enclosure, although the entire space need not be filled with the acoustically absorbent material to insulate the outer surface 48 from vibrations that cause spurious noise. Turning to FIG. 4, the outer surface 16 of the closed end 20 of the enclosure 12 is provided with a 5-way binding post 58 which is electrically coupled to the speaker driver 22 by a lead 59. Suspension hardware 60 is provided for suspending the speaker system 10 from a ceiling or from other support structures.

In operation, sound produced from the speaker driver 22 has a spherical wavefront. Passage of the sound waves through the channels 42 of the in-line phase plug 26 transforms the sound waves such that they acquire a more linear wavefront. The sound waves, now with a substantially linear wavefront, are then directed by the wave guide 24 out of the open end 18 of the enclosure 12. The directed sound waves, because of their linear wavefront, are limited in their dispersion once the sound waves exit the open end 18. In addition, the acoustic trap 28 absorbs sound waves at the perimeter of the wave guide 24 to further confine the sound waves and limit sound dispersion. Moreover, the stand-off hardware 38 coupling the speaker driver 22 to the mount 32, prevents direct contact between the speaker driver and the other components (the in-line phase plug 26 and the wave guide 24) coupled to the mount. Furthermore, the 'floating' mount 32 is substantially acoustically isolated from the speaker enclosure 12. As a result, the speaker enclosure 12 is prevented from becoming a sound radiator, and extraneous resonation of the enclosure is minimized, further reducing sound dispersion.

Turning now to FIGS. 5 through 8, a second embodiment of a speaker system 110 according to the invention, substantially similar to the first embodiment (with like parts having numbers incremented by 100), is shown. The speaker system 110 includes a rectilinear enclosure 112, a full-range speaker driver 122, a wave guide 124 having a rectangular cross-section, a rectilinear in-line phase plug 126 (see FIG. 6), and an acoustic trap 128 (see FIGS. 5 and 7). A 5-way binding post 158 which is electrically coupled to the speaker driver 122 with a lead 159, and suspension hardware 160 is coupled to the closed end of the speaker enclosure for suspending the speaker system 110. It will be appreciated that the various components can also be shaped and otherwise adapted to form a speaker system having various other shapes, e.g., having an octagonal cross-section.

Figure 9:
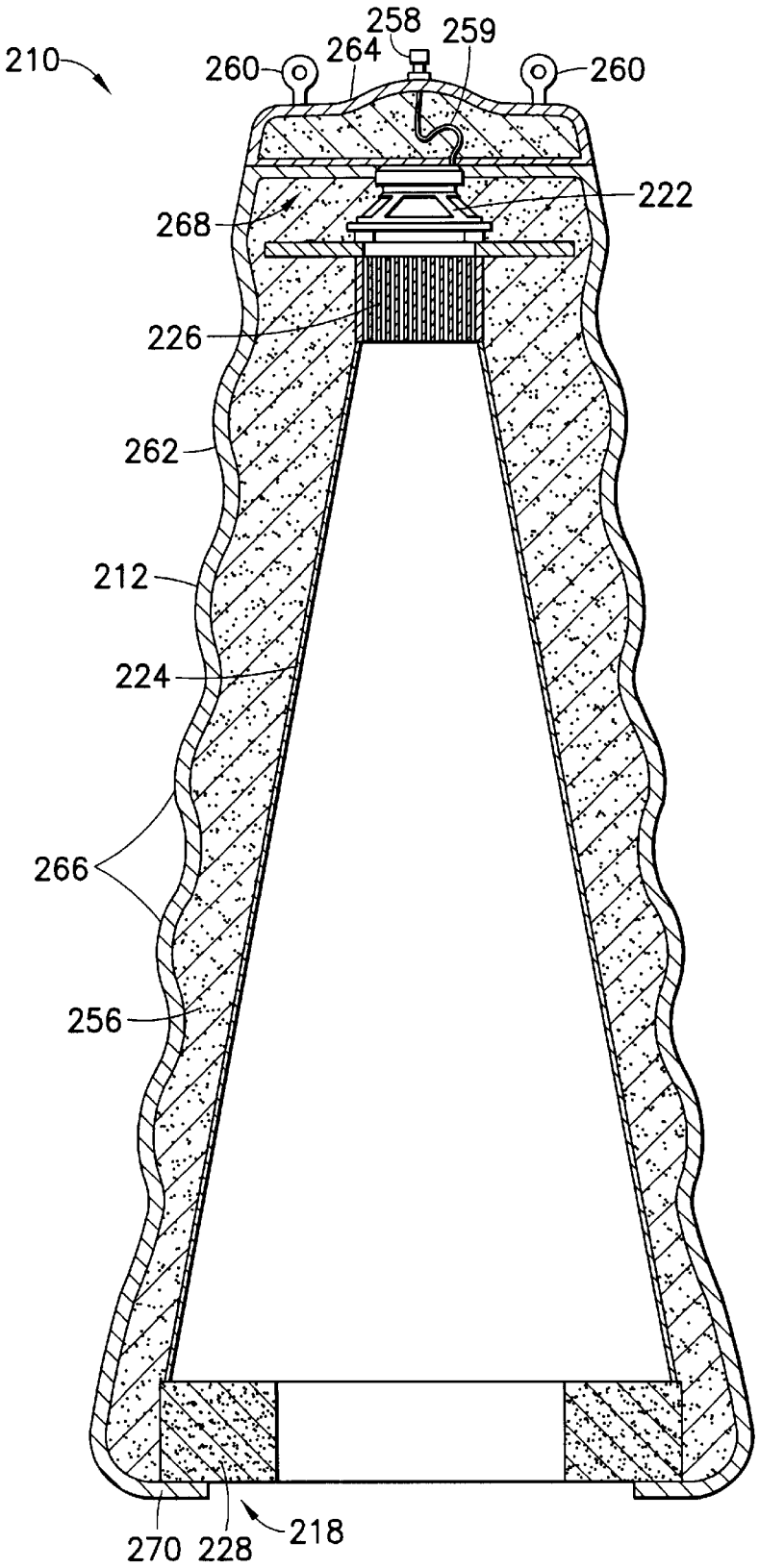
FIG. 9 is a partial side view of a third embodiment of a directional speaker system according to the invention.

Referring now to FIG. 9, a third embodiment of a speaker system 210 according to the invention, similar to the first embodiment (with like parts having numbers incremented by 200), is shown. The speaker system 210 includes a molded enclosure 212, a full-range speaker driver 222, a frustoconical wave guide 224, an in-line phase plug 226, an acoustic trap 228, and preferably acoustically absorbent material 256 between the wave guide 224, in-line phase plug 226, and speaker 222, and the enclosure 212. The speaker enclosure 212 preferably includes a frustoconical portion 262 and a cap portion 264. The frustoconical portion 262 preferably has a plurality of undulations 266 between first and second open ends 268 and 218 respectively, and an inner lip 270 formed at the second open end 218. The cap portion 264 seals the first open end 268, preferably by being threadedly coupled to the first open end 268, and is provided with suspension hardware 260. In addition, a 5-way binding post 258 is mechanically coupled to the cap portion 264 and electrically coupled to the speaker driver 222 by a lead 259. The acoustic trap 228 seats on the inner lip 270. An acoustically absorbent material 256 is provided between the speaker enclosure 212 and the wave guide 224, the in-line phase plug 226 and the speaker driver 222.

It will be appreciated that the out-of-phase sound waves directed rearward from the speaker travel in the space (filled with acoustically absorbent material 256) between the enclosure 212 and the wave guide 224. The out-of-phase sound waves are randomized by the undulations 266 which substantially prevent the creation of standing waves which can cause distortion or are otherwise absorbed by the acoustically absorbent material 256 to prevent the speaker enclosure 212 from resonating.

Figure 10:
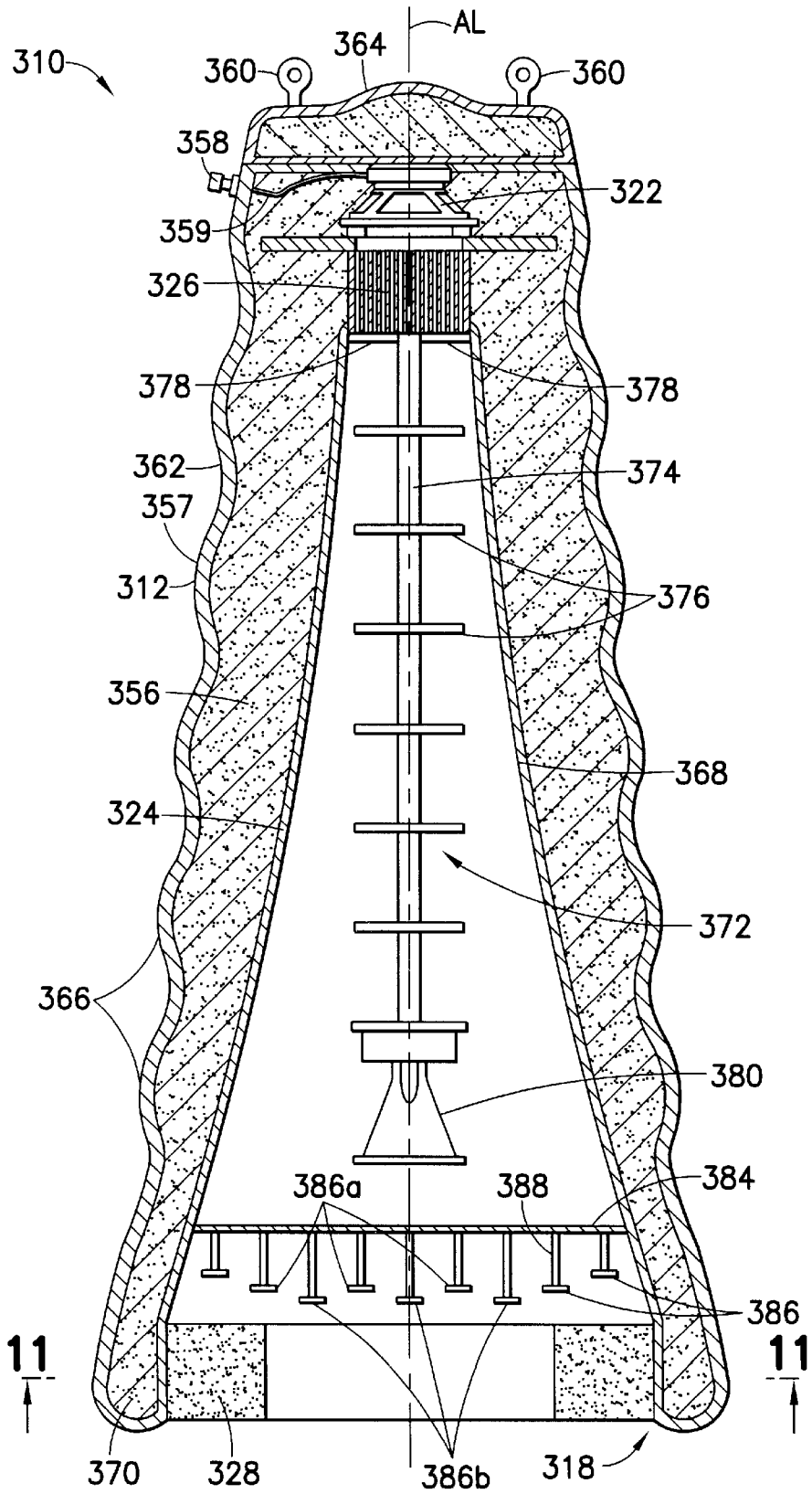
FIG. 10 is a partial side view of a fourth embodiment of a directional speaker system according to the invention.
Figure 11:
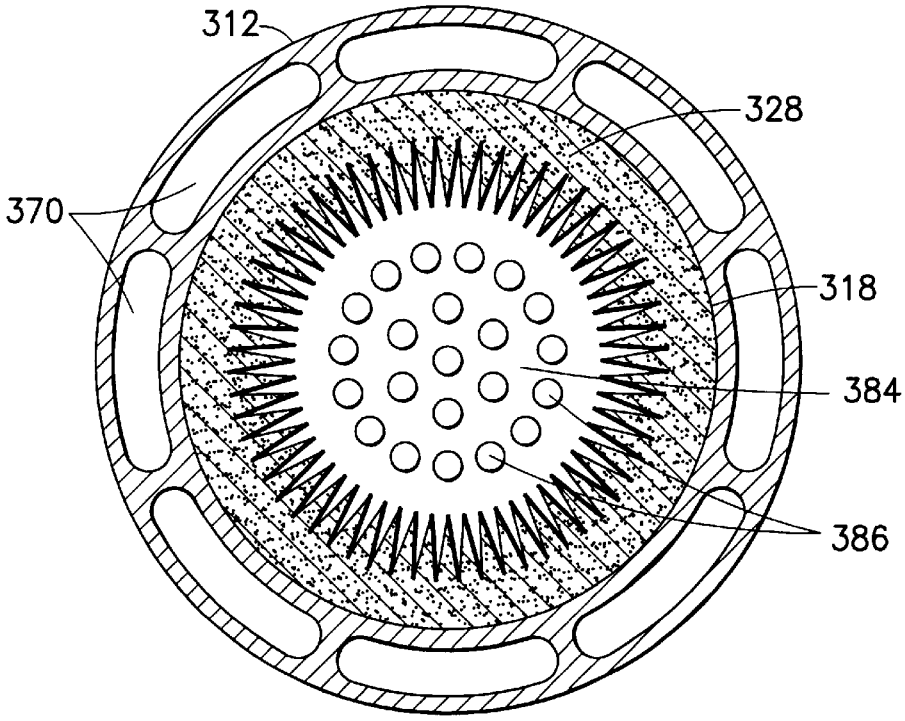
FIG. 11 is a cross-section through line 11—11 in FIG. 10.

Referring now to FIGS. 10 and 11, a fourth embodiment of a speaker system 310 according to the invention, similar to the third embodiment (with like parts having numbers incremented by 100 relative to the third embodiment), is shown. The speaker system 310 includes an enclosure 312, a full-range speaker driver 322, a wave guide 324, an in-line phase plug 326, and an acoustic trap 328. The speaker enclosure preferably includes a cap portion 364 which provides a closed end to the enclosure, and a lower portion 362 which is preferably integrally molded with the wave guide 324 to be a unitary component having a preferably annular hollow 357. The cap portion 364 is preferably provided with suspension hardware 360. The hollow 357 in the lower portion 362 is preferably filled with an acoustically absorbent material 356. In addition, the lower portion 362 of the speaker enclosure 312 preferably has a plurality of undulations 366. A 5-way binding post 358 is mechanically coupled to the enclosure 312, preferably at the lower portion 362 (or alternatively to the cap portion 364), and is electrically coupled to the speaker driver 322 by a lead 359. At the open end 318 of the speaker enclosure 312, the enclosure 312 is provided with a plurality of preferably evenly spaced apart and preferably arc-shaped openings 370 into the hollow 357. The openings 370 are preferably provided between the outer surface of the enclosure 312 and the second end of the wave guide 324. The out-of-phase sound waves directed rearward from the speaker driver 322 travel through the hollow 357 and out the openings 370. The wave guide 324 has a slightly arcuate side wall 368. The acoustic trap 328 is coupled at the open end 318 of the enclosure 312, e.g., by gluing.

The speaker system 310 further comprises a wave guide phase plug 372 preferably including a preferably hollow central post 374 within the wave guide and a plurality of preferably disc shaped baffles 376 situated concentrically about the post 374. The post 374 is preferably coupled to the top of the wave guide via narrow mounting brackets 378. A highly directional horn tweeter 380 is coupled to the bottom of the central post 374 and oriented toward the open end 318. Leads (not shown) extend from the horn tweeter 380 up through the post to be coupled to crossover circuitry (not shown) which is also coupled to the speaker driver 322. A substantially acoustically transparent baffle plate 384 is provided between the horn tweeter 380 and the acoustic trap 328. For example, the baffle plate 384 may be made from a metal or plastic screen. A plurality of disc-like baffles 386 are coupled to the baffle plate 384 by mounts 388, some of the baffles, e.g., 386*a*, being provided at different heights relative to other baffles, e.g., 386*b*.

Figure 12:
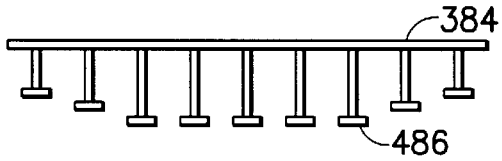
FIG. 12 is an alternate embodiment of a plate baffle of the fourth embodiment of the directional speaker system of the invention.
Figure 13:
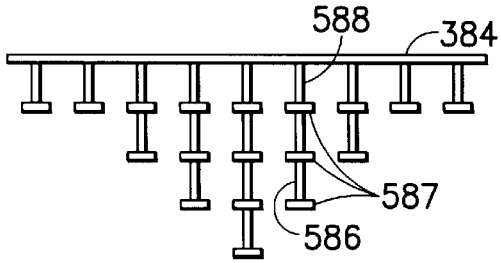
FIG. 13 is yet another embodiment of a plate baffle of the fourth embodiment of the directional speaker system of the invention.

The baffles 386 may be replaced with baffles differently configured, if desired. For example, turning to FIG. 12, it will be appreciated that baffles 486 are provided in an arc. Of course, other configurations can be utilized with configurations being optimized on the basis of the shape of the wave guide, the frequency range of the speaker driver, and other factors. Referring to FIG. 13, compound baffles 586 comprising multiple discs 587 coupled to a single mount 588 may be provided on the baffle plate 384 or otherwise configured within the wave guide.

Referring back to FIGS. 10 and 11, sound waves propagated in the forward direction by the speaker driver 322 exit the wave guide 324, while sound waves propagated in the rearward direction are out-of-phase with the forwardly directed sound waves. The rearward directed sound waves travel through the absorbent material 356 in the hollow space 357. Sound waves not absorbed by the absorbent material 356 exit the openings 370. At the perimeter of the opening 318 of the enclosure 312, some of the forwardly propagated sound waves exiting the wave guide and rearwardly propagated sound waves exiting the openings 370 are theoretically canceled by each other to confine the dispersion of the remaining sound waves. In addition, the wave guide phase plug 372 and the baffle plate 384 operate to further flatten the wavefront and thereby further constrain the sound wave. The sound waves exiting the horn tweeter 380 are naturally highly directional and subject to relatively minimal dispersion. The horn tweeter 380 operates to replace and augment some high frequencies lost due to wavefront manipulation.

There have been described and illustrated herein several embodiments of a speaker system which has improved directionality. While particular embodiments of the invention have been described, it is not intended that the invention be limited thereto, as it is intended that the invention be as broad in scope as the art will allow and that the specification be read likewise. Thus, while the speaker enclosure has been shown in several shapes, it will be appreciated that the enclosure can assume other shapes, as the general shape of the enclosure is not necessarily critical to the function of the speaker system. Also, while the wave guide is disclosed as being molded, it will be appreciated that the wave guide may be formed from a sheet material, e.g., plastic. In addition, while certain acoustically absorbent or insulating materials have been disclosed, other materials can likewise be used, e.g., fiberglass or blown foam. Also while the in-line phase plug is shown positioned above the wave guide, it will be appreciated that the in-line phase plug can also be positioned within the wave-guide, between the wave guide and the acoustic trap, or below the open end. Furthermore, while the acoustic trap is disclosed as having a saw tooth profile, this is only preferred and not required. Moreover, while a 5-way binding post has been disclosed for electrically coupling the speaker driver to a signal source, other standard couplings can be used. Also, while in one embodiment, the horn tweeter has been shown suspended within the wave guide by the post of the wave guide phase plug, it will be appreciated that the horn tweeter may otherwise be mounted. Moreover, the horn tweeter may alternatively be provided below the baffle plate. Furthermore, while the various embodiments disclose certain unique elements, it will be appreciated that the intention of the various embodiments is to illustrate various aspects of the invention that can be used separately or together in yet other configurations. For example, the unitary molded enclosure and wave guide can be used without the wave guide phase plug and openings in the enclosure. In addition, each of the embodiments may have arcuate or relatively straighter walls. It will therefore be appreciated by those skilled in the art that yet other modifications could be made to the provided invention without deviating from its spirit and scope as so claimed.

What is claimed is:

1. A directional speaker system, comprising:

a) an elongate enclosure having an inner surface and an outer surface along a length of the enclosure, the enclosure having at one end of its length an open end and at the other end of its length a closed end, and defining a longitudinal axis $A_L$ which passes through each of said open and closed ends;

b) a speaker driver means for producing sound waves having a wavefront, said speaker driver means having a front side and a back side, and being positioned within said enclosure such that sound waves produced by said speaker driver means and emanating from said front side of said speaker driver means are directed through said open end;

c) directional means for directing the sound waves including a first end having a first dimension, a second end located substantially adjacent said open end of said enclosure and having a second dimension greater than said first dimension, wherein a space is provided between said directional means and said enclosure, said space being in communication with aid back side of said speaker driver means, and at least one opening is provided into said space such that sound waves directed from said back side of said speaker driver means are provided a path through said space and out of said speaker system through said at least one opening; and d) an acoustically absorbent material provided at said open end of said enclosure which constricts said open end relative to said second end of said directional means.

2. A speaker system according to claim 1, wherein:

said at least one opening is provided at said open end of said enclosure between said outer surface of said enclosure and said directional means.

3. A speaker system according to claim 1, wherein:

said space is an annular space which substantially completely surrounds said directional means.

4. A speaker system according to claim 1, wherein:

said directional means and said enclosure are formed as a unitary construct.

5. A speaker system according to claim 1, wherein:

said directional means is substantially frustoconical in shape.

6. A speaker system according to claim 1, wherein:

said at least one opening is provided about said second end of said directional means.

7. A speaker system according to claim 1, further comprising:

a first acoustically absorbent material separating said speaker driver, said directional means, and said wavefront manipulation means from said enclosure.

8. A speaker system, comprising:

a) an enclosure having an inner surface, an outer surface, an open end, and a closed end;

b) a speaker driver means for producing sound waves having a wavefront, said speaker driver means having a front side and a back side, and being positioned within said enclosure such that said front side is directed toward said open end;

c) directional means for directing the sound waves including a first end having a first dimension, a second end located substantially adjacent said open end of said enclosure and having a second dimension greater than said first dimension;

d) first wavefront manipulation means for altering the wavefront, said first wavefront manipulation means substantially entirely situated between said speaker driver and said first end of said directional means; and e) second wavefront manipulation means for altering the wavefront, said second wavefront manipulation means located at least partially within said directional means, wherein a space is provided between said directional means and said enclosure, said space being in communication with said back side of said speaker driver means, and a plurality of openings are provided into said space, said openings being spaced apart about said open end, such that sound waves directed from said back side of said speaker driver means are provided a path through said space and out of said speaker system through said plurality of openings.

9. A speaker system according to claim 8, further comprising:

f) a relatively high frequency speaker driver coupled between said second wavefront manipulation means and said open end of said enclosure.

10. A speaker system according to claim 1, further comprising:

a mounting means for coupling said speaker driver and said first wavefront manipulation means, said mounting means being substantially acoustically isolated from said enclosure.

11. A directional speaker system, comprising:

a) an elongate enclosure having an inner surface and an outer surface along a length of the enclosure, the enclosure having at one end of its length an open end and at the other end of its length a closed end, and defining a longitudinal axis $A_L$ which passes through each of said open and closed ends;

b) a speaker driver means for producing sound waves having a wavefront, said speaker driver means having a front side and a back side, and being positioned within said enclosure such that sound waves produced by said speaker driver means and emanating from said front side of said speaker driver means are directed through said open end;

c) directional means for directing the sound waves, including a first end having a first dimension, a second end located substantially adjacent said open end of said enclosure and having a second dimension greater than said first dimension;

d) first wavefront manipulation means for altering the wavefront, said first wavefront manipulation means substantially situated between said speaker driver and said first end of said directional means; and e) a first acoustically absorbent material separating said speaker driver, said directional means, and said wavefront manipulation means from said enclosure, wherein a space is provided between said directional means and said enclosure, said space being in communication with said back side of said speaker driver means, and at least one opening is provided into said space such that sound waves directed from said back side of said speaker driver means are provided a path through said space and out of said speaker system through said at least one opening.

12. A directional speaker system, comprising:

a) an enclosure having an inner surface, an outer surface, an open end, and a closed end;

b) a speaker driver means for producing sound waves having a wavefront, said speaker driver means having a front side and a back side, and being positioned within said enclosure such that said front side is directed toward said open end;

c) directional means for directing the sound waves, including a first end having a first dimension, a second end located substantially adjacent said open end of said enclosure and having a second dimension greater than said first dimension;

d) first wavefront manipulation means for altering the wavefront, said first wavefront manipulation means substantially situated between said speaker driver and said first end of said directional means;

e) a first acoustically absorbent material separating said speaker driver, said directional means, and said wavefront manipulation means from said enclosure; and f) an acoustically absorbent ring provided at said open end of said enclosure which constricts said open end relative to said second end of said directional means, wherein a space is provided between said directional means and said enclosure, said space being in communication with said back side of said speaker driver means, and at least one opening is provided into said space such that sound waves directed from said back side of said speaker driver means are provided a path through said space and out of said speaker system through said at least one opening.

13. A directional speaker system according to claim 12, further comprising:

g) second wavefront manipulation means for altering the wavefront, said second wavefront manipulation means being located at least partially within said directional means; and h) a relatively high frequency speaker driver coupled between said second wavefront manipulation means and said open end of said enclosure.

* * * * *